US008112872B2

(12) United States Patent
Sato et al.

(10) Patent No.: US 8,112,872 B2
(45) Date of Patent: Feb. 14, 2012

(54) METHOD OF MANUFACTURING A COIL COMPONENT

(75) Inventors: Shinichi Sato, Tokyo (JP); Satoshi Kurimoto, Tokyo (JP); Makoto Morita, Tokyo (JP); Akira Takashima, Tokyo (JP); Sumio Takahashi, Tokyo (JP); Yoshiaki Kitajima, Tokyo (JP)

(73) Assignee: TDK Corporation, Tokyo (JP)

( * ) Notice: Subject to any disclaimer, the term of this patent is extended or adjusted under 35 U.S.C. 154(b) by 167 days.

(21) Appl. No.: 12/213,749

(22) Filed: Jun. 24, 2008

(65) Prior Publication Data

US 2009/0315659 A1 Dec. 24, 2009

(51) Int. Cl.
*H01F 7/128* (2006.01)
*H01F 7/127* (2006.01)

(52) U.S. Cl. ..... 29/602.1; 29/605; 29/606; 29/857; 336/205; 264/272.15; 264/272.19

(58) Field of Classification Search ..... 29/602.1, 29/605, 606, 857, 858, 860; 336/205, 221; 264/272.19, 272.15
See application file for complete search history.

(56) References Cited

U.S. PATENT DOCUMENTS 3,359,520 A * 12/1967 Foerster ..... 29/605 X
5,149,483 A * 9/1992 Okey et al. ..... 264/272.19

FOREIGN PATENT DOCUMENTS

JP 61150313 A * 7/1986 ..... 29/605
JP A-61-160920 7/1986
JP A-3-163808 7/1991
JP A-7-302719 11/1995
JP A-10-321438 12/1998
JP A-2001-85245 3/2001
JP A-2001-223118 8/2001
JP A-2002-110428 4/2002
JP A-2004-311755 11/2004
JP A-2005-210055 8/2005
JP A-2005-217280 8/2005
JP A-2007-173573 7/2007
JP A-2007-173576 7/2007

* cited by examiner

*Primary Examiner* — A. Dexter Tugbang
(74) *Attorney, Agent, or Firm* — Oliff & Berridge, PLC

(57) ABSTRACT

A coil component having an easily discernible orientation, and a method of producing such a coil component that facilitates the injection of resin. A coil component includes a core with a winding portion, first and second flanges disposed on either end of the winding portion, and a winding accommodating region defined by the winding portion and the first and second flanges, terminal electrodes disposed on the second flange and a winding wound about the winding portion and connected to the terminal electrodes. An insulating resin is formed over the winding at the winding accommodating region. A marker made from a material the same as the insulating resin is provided at outer peripheral surface of the flanges.

4 Claims, 3 Drawing Sheets

METHOD OF MANUFACTURING A COIL COMPONENT

TECHNICAL FIELD

The present invention relates to a coil component and method for producing the coil component.

BACKGROUND

One type of coil component well known in the art has a core including a winding portion and a pair of flanges, and a winding wound over the winding portion. Japanese Patent Application Publication No. H07-302719 discloses a technique for protecting the wound portion of the winding with an insulating resin. More specifically, a resin coating is formed over the wound area of the winding by injecting a liquid resin thereon.

In addition, the coil component is conventionally provided with terminal electrodes electrically connected to each end of the winding. The terminal electrodes are provided on the surface-mounting side of the coil component to be electrically connected to electrodes formed on a circuit board when the coil component is mounted on the circuit board. In order to ensure reliable contact between the terminal electrodes and the electrodes on the circuit board, the coil component must be mounted in a precise orientation onto a precise position of the circuit board.

As technological advances are made to increase the performance and reduce the size of electronic devices employing coil components, such as mobile telephones, there has been increasing demand to reduce the size and increase the mounting density of the coil components themselves. To meet this demand, coil components are now being manufactured with a core size of a few millimeters. However, reducing the core size also reduces the size of the winding in the wound area, making it more difficult to fill this wound area with resin.

Further, the reduced size of the coil component has made it more difficult to visually determine the position and orientation of the coil component being mounted on the circuit board, often leading to mounting errors. Changing the shape of the core or adding a marker or the like to the core has helped confirm the correct orientation of the coil component, but increases the difficulty of the manufacturing process with additional steps to change the core shape and apply a marker.

SUMMARY

Therefore, it is an object of the present invention to provide a coil component having an easily discernible orientation, and to provide a method of manufacturing such a coil component that facilitates the injection of resin.

This and other object of the present invention will be attained by a coil component including a core, terminal electrodes, a winding, an insulating resin, and a marker. The core includes a winding portion having a first end and a second end, a first flange disposed at the first end and having an outer peripheral surface, and a second flange disposed at the second end and having an outer peripheral surface. A winding accommodating region is defined by the winding portion and the first and second flanges. The terminal electrodes are disposed on at least one of the first flange and the second flange. The winding is wound about the winding portion to provide a wound portion and is connected to the terminal electrodes. The insulating resin layer covers the wound portion of the winding within the winding accommodating region. The marker is formed of a material the same as that of the insulating resin layer and is deposited on a part of the outer peripheral surface on the first flange and the second flange.

In another aspect of the invention, there is provided a method of producing a coil component including a core having a winding portion, a pair of flanges having an outer peripheral surface and providing a winding accommodating region defined by the winding portion and the pair of flanges; terminal electrodes disposed on at least one of the pair of flanges; and a winding wound about the winding portion and connected to the terminal electrodes. The method includes (a) wrapping the winding about the winding portion in layers within the winding accommodating region to provide a wound portion, (b) connecting ends of the winding to the terminal electrodes, and (c) immersing a portion of the outer peripheral surface of the pair of flanges in a liquid resin bath to form a resin coating over the wound portion of the winding within the winding accommodating region, and simultaneously forming a marker made from the liquid resin on the immersed portion of the outer peripheral surface.

BRIEF DESCRIPTION OF THE DRAWINGS

The particular features and advantages of the invention as well as other objects will become apparent from the following description taken in connection with the accompanying drawings, in which:

FIG. 5(*a*) shows the core prior to immersion in a liquid resin bath;

FIG. 5(*b*) shows the core immersed in the liquid resin bath;

FIG. 5(*c*) shows the liquid resin rising due to the capillary effect; and

FIG. 5(*d*) shows the winding covered with liquid resin; and

FIG. 5(*e*) shows the core after being lifted out of the liquid resin bath.

EMBODIMENT

Figure 1:
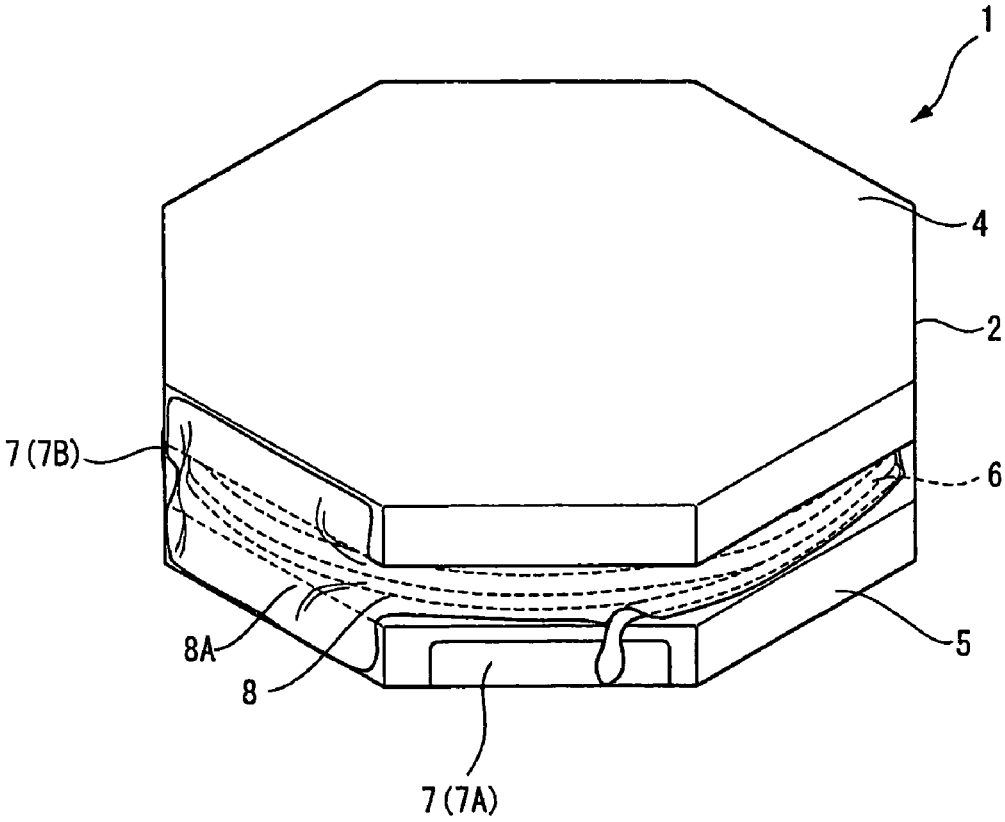
FIG. 1 is a perspective view of a coil component according to one embodiment of the present invention.

Next, a coil component and a method for producing the coil component according to one embodiment of the present invention will be described with reference to FIGS. 1 through 5. A coil component 1 shown in FIG. 1 primarily includes a core 2, a single winding 6, terminal electrodes 7, and a resin coating 8.

Figure 2:
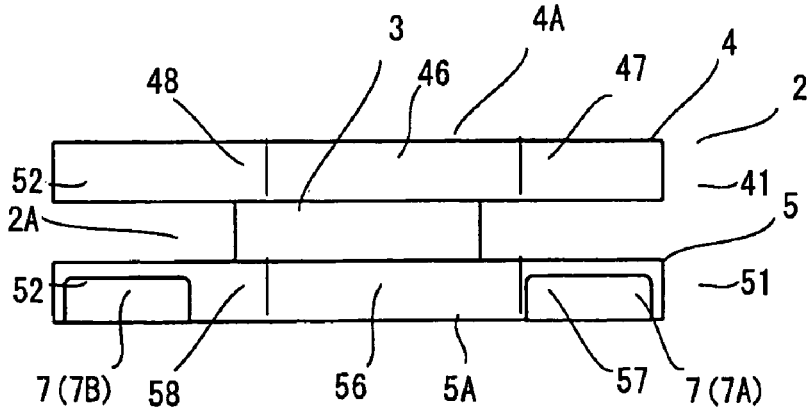
FIG. 2 is a rear view of a core in the coil component according to the embodiment.

As shown in FIG. 2, the core 2 is a few millimeters by a few millimeters wide with a height of about 1 millimeter. The core 2 is basically made from magnetic material such as ferrite and includes a substantially cylindrical winding portion 3, and a first flange 4 and a second flange 5 disposed one on either end of the winding portion 3. A winding accommodating region 2A for accommodating the winding 6 is defined between the first and second flanges 4 and 5 around the winding portion 3. Since the first and second flanges 4 and 5 are symmetrical in shape, only the second flange 5 will be described below.

Figure 3:
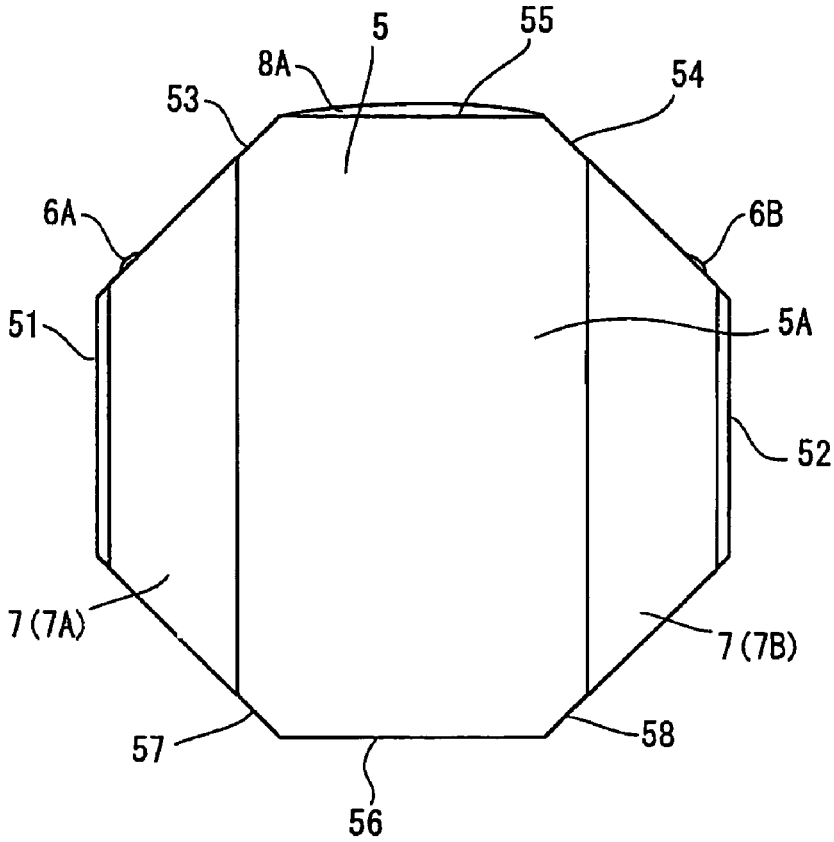
FIG. 3 is a bottom view of the coil component according to the embodiment.
Figure 4:
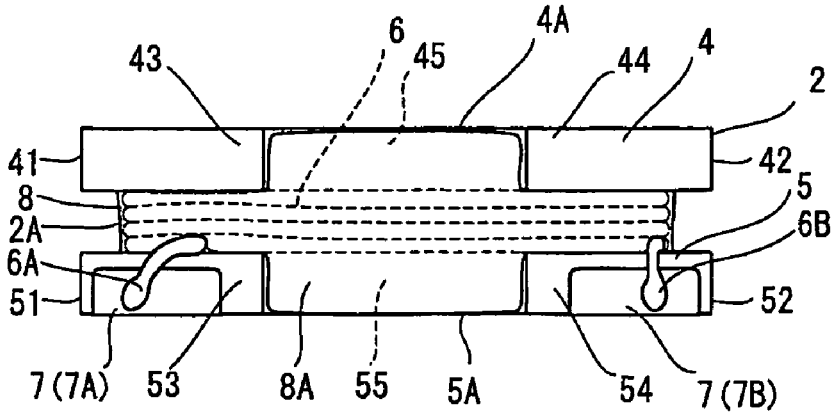
FIG. 4 is a front view of the coil component according to the embodiment.
Figure 5A:
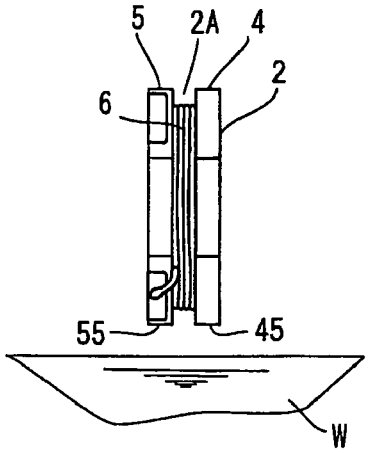
FIG. 5 is a schematic diagram illustrating a method of manufacturing the coil component according to the embodiment, where.
Figure 5B:
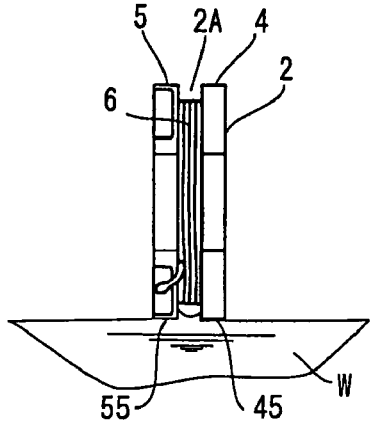
Figure 5C:
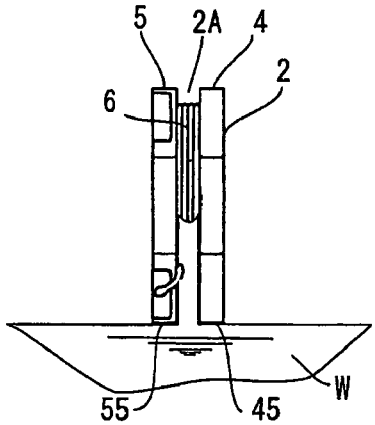
Figure 5D:
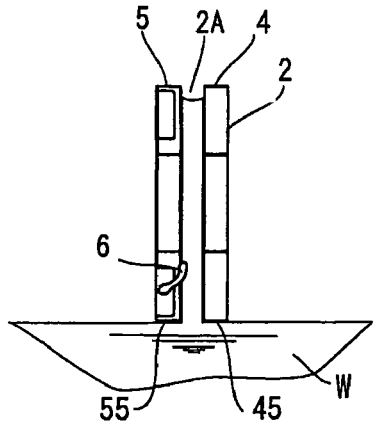
Figure 5E:
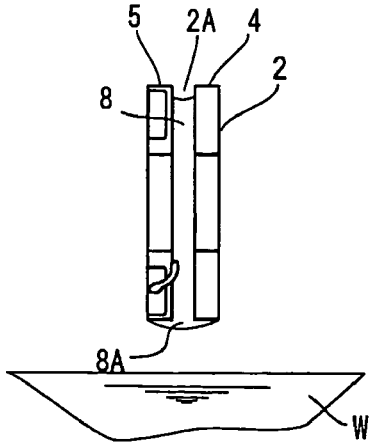

The second flange 5 is a plate member having a prescribed thickness. The second flange 5 has a bottom surface 5A (FIG. 3) that is substantially octagonal in shape and serves as the mounting surface when mounting the coil component 1 on a circuit board (not shown). As shown in FIGS. 2 through 4, the second flange 5 has a first peripheral surface 51, a second peripheral surface 52, a first omitted peripheral surface 53, a second omitted peripheral surface 54, a third peripheral surface 55, a fourth peripheral surface 56, a third omitted peripheral surface 57, and a fourth omitted peripheral surface 58 all extending from the peripheral edge of the bottom surface 5A toward the first flange 4.

The first and second peripheral surfaces 51 and 52 are parallel surfaces, the first and second omitted peripheral surfaces 53 and 54 are disposed on one side of the first and second peripheral surfaces 51 and 52, and the third and fourth omitted peripheral surfaces 57 and 58 are disposed on the other side of the first and second peripheral surfaces 51 and 52. The third peripheral surface 55 is provided between the first and second omitted peripheral surfaces 53 and 54, and the fourth peripheral surface 56 is provided between the third and fourth omitted peripheral surfaces 57 and 58. The third and fourth peripheral surfaces 55 and 56 are substantially parallel. These peripheral surfaces 51-58 constitute the outer peripheral surface of the second flange 5.

When the coil component 1 is mounted on a circuit board, the first, second, third, and fourth peripheral surfaces 51, 52, 55, and 56 are substantially in contact with or in close proximity to the electronic parts of other neighboring coil components. When viewing the bottom surface 5A along the direction of a line connecting the first and second flanges 4 and 5, the first, second, third, and fourth omitted peripheral surfaces 53, 54, 57, and 58 constitute the chamfered four corners of an imaginary square constructed by extending each of the first, second, third, and fourth peripheral surfaces 51, 52, 55, and 56. This configuration inhibits the first, second, third, and fourth omitted peripheral surfaces 53, 54, 57, and 58 from substantially coming into contact with other electronic parts.

As shown in FIGS. 2 and 4, a top surface 4A is provided on the first flange 4 on the opposite side of the core 2 from the bottom surface 5A. The first flange 4 has a first peripheral surface 41, a second peripheral surface 42, a first omitted peripheral surface 43, a second omitted peripheral surface 44, a third peripheral surface 45, a fourth peripheral surface 46, a third omitted peripheral surface 47, and a fourth omitted peripheral surface 48 those corresponding to the outer peripheral surface of the second flange 5.

The winding 6 is a copper wire having an insulating coating and is wound about the winding portion 3 (FIG. 2). As shown in FIG. 4, the winding 6 is accommodated in the winding accommodating region 2A. The winding 6 has a first end 6A and a second end 6B electrically connected to the terminal electrodes 7.

The terminal electrodes 7 include a first terminal electrode 7A and a second terminal electrode 7B. As shown in FIGS. 2-4, the first terminal electrode 7A is provided across the first omitted peripheral surface 53, a portion of the bottom surface 5A, and the third omitted peripheral surface 57. The second terminal electrode 7B is provided across the second omitted peripheral surface 54, a portion of the bottom surface 5A separated from the first terminal electrode 7A, and the fourth omitted peripheral surface 58. The first end 6A of the winding 6 is electrically connected to the first terminal electrode 7A at a portion of the first omitted peripheral surface 53, while the second end 6B of the winding 6 is electrically connected to the second terminal electrode 7B at a portion of the second omitted peripheral surface 54.

As shown in FIG. 4, the resin coating 8 is injected into the winding accommodating region 2A over the wound portion of the winding 6 to protect the winding 6. Further, a marker 8A projects from the third peripheral surfaces 45 and 55. The marker 8A is formed integrally with the resin coating 8 and is made from a material the same as that of the resin coating 8. The first and second terminal electrodes 7A and 7B serving as positions for connecting the ends of the winding 6 are formed in the first omitted peripheral surface 53 and second omitted peripheral surface 54 disposed on both sides of the third peripheral surface 55 of the second flange 5. Accordingly, the positions of the terminal electrodes 7 relative to the bottom surface 5A, i.e., the mounting surface, can be determined based on the marker 8A. Therefore, mounting errors can be reduced by always maintaining the coil component 1 in a given orientation such that an imaginary line from the center of the coil component 1 to the marker 8A is in a fixed direction when mounting the coil component 1 on the circuit board.

When manufacturing the coil component 1, the winding 6 is wound about the winding portion 3 within the winding accommodating region 2A to provide a multilayer windings (winding step), and subsequently the first and second ends 6A and 6B of the wound winding 6 are connected to the terminal electrodes 7 (wire connecting step).

For forming the resin coating 8 over the winding 6, as shown in FIG. 5(*a*), the core 2 is held above a liquid resin bath W filled with liquid resin such that the third peripheral surfaces 45 and 55 are facing downward. From this state, the core 2 is moved to and held in a position at which the third peripheral surfaces 45 and 55 contact the surface of the liquid resin (FIG. 5(*b*)). Since the height of the core 2 is approximately 1 mm, the distance between the first and second flanges 4 and 5 is approximately 0.4 mm. Hence, when the third peripheral surfaces 45 and 55 are immersed in the liquid resin of the liquid resin bath W, the liquid resin penetrates the winding accommodating region 2A between the first and second flanges 4 and 5 due to the capillary effect (FIG. 5(*c*)). Since the winding 6 is tightly wound within the winding accommodating region 2A, gaps within the winding 6 are small. Since the degree to which liquid rises due to capillary action is inversely proportional to the diameter of the tube, a force acts to draw up the liquid resin in the narrow gaps formed in the wound portion of the winding 6, resulting in the liquid resin penetrating the wound portion of the winding 6 across the entire portion (FIG. 5(*d*)). After the resin coating 8 has been formed and the core 2 lifted out of the liquid resin bath W (FIG. 5(*e*)), the liquid resin remains deposited on the third peripheral surfaces 45 and 55, which were the surfaces that contacted the liquid resin in the liquid resin bath W. This concludes the step of immersing the core 2 into the liquid resin bath W (resin immersion step). Subsequent hardening of the resin completes formation of the resin coating 8 and marker 8A.

As a modification, while the marker 8A is provided in a location where the terminal electrodes 7 are not formed in the above description, the marker 8A may be provided on the outer peripheral surface at the location of the terminal electrodes 7. With this configuration, the terminal electrodes 7 are protected by resin, reducing the chances of short-circuiting. Accordingly, this configuration suppresses the occurrence of short-circuiting between neighboring coil components 1, even when coil components 1 are mounted very densely. Further, the resin coating 8 and marker 8A may be formed of a resin with insulating properties, or a resin containing ferrite powder, for example. The properties of the coil component 1 can be varied by controlling the ratio of the ferrite powder in the resin. Further, the resin need not be applied using the liquid resin bath W, but may be supplied with a resin supplying apparatus having an aperture whose diameter corresponds to the distance between the first and second flanges 4 and 5.

While the invention has been described in detail with reference to the specific embodiment thereof, it would be apparent to those skilled in the art that various changes and modifications may be made therein without departing from the spirit of the invention.

The invention claimed is:

1. A method of producing a coil component comprising a core having a winding portion, a pair of flanges having an outer peripheral surface and providing a winding accommodating region defined by the winding portion and the pair of flanges; terminal electrodes disposed on at least one of the pair of flanges; and a winding wound about the winding portion and connected to the terminal electrodes;

the method comprising:

wrapping the winding about the winding portion in layers within the winding accommodating region to provide a wound portion;

connecting ends of the winding to the terminal electrodes; and immersing a portion of the outer peripheral surface, less than a whole of the outer peripheral surface, of the pair of flanges in a liquid resin bath to permit the liquid resin to penetrate the winding accommodating region between the pair of flanges by a capillary effect to form a resin coating over an entire outer peripheral surface of the winding portion of the winding within the winding accommodating region, and simultaneously forming a marker made from the liquid resin on the immersed portion of the outer peripheral surface, wherein the immersing causes the liquid resin to rise in a direction opposing the liquid resin bath to penetrate the winding accommodating region between the pair of flanges due to the capillary effect, and the liquid resin only penetrates the winding accommodating region between the pair of flanges.

2. The method of producing a coil component as claimed in claim 1, wherein the pair of flanges includes a first flange and a second flange having outer profiles identical to each other and aligned with each other in an axial direction of the winding portion; and wherein in the immersing process, a portion of the outer peripheral surface of the first flange and a portion of the outer peripheral surface of the second flange are aligned with each other in the axial direction so that the portions are equally immersed into the liquid resin.

3. The method of producing a coil component as claimed in claim 1, wherein the pair of flanges are substantially octagonal in shape.

4. The method of producing a coil component as claimed in claim 1, wherein, in the immersing step, only a portion of the outer peripheral surface of the pair of flanges is immersed in the liquid resin bath.

* * * * *